US006063015A

United States Patent [19]

Johnston

[11] Patent Number: 6,063,015

[45] Date of Patent: May 16, 2000

[54] EXERCISE ASSEMBLY

[76] Inventor: Stevent D. Johnston, 179 W. Summit St., Harbor Springs, Mich. 49740

[21] Appl. No.: 09/203,144

[22] Filed: Dec. 1, 1998

[51] Int. Cl.[7] ..... A63B 26/00

[52] U.S. Cl. ..... 482/142; 482/907

[58] Field of Search ..... 482/130, 140, 482/142, 907

[56] References Cited

U.S. PATENT DOCUMENTS

| | | | |
|---|---|---|---|
| D. 169,916 | 6/1953 | Stevens | 482/142 |
| 2,429,939 | 10/1947 | Masterson | 482/142 |
| 3,709,487 | 1/1973 | Walker | 482/130 |
| 3,891,207 | 6/1975 | Helliwell | 482/142 |
| 4,927,135 | 5/1990 | Nieppola | 272/63 |
| 4,927,139 | 5/1990 | Taltre | 272/144 |
| 5,112,287 | 5/1992 | Brewer | 482/130 |
| 5,795,276 | 8/1998 | Almeda | 482/142 |

*Primary Examiner*—Michael A. Brown
*Attorney, Agent, or Firm*—Howard & Howard

[57] ABSTRACT

An exercise assembly 10 includes a support platform 12 for resting upon a floor and an arcuate section 14 extends upwardly and rearwardly from the platform 12 to define a storage space 16 between the platform 12 and the arcuate section 14. And a foot section 18, comprising an intermediate portion 24 and a toe portion 26, extends from the arcuate section 14 to a distal end 20 for resting upon a floor in a use position. The assembly is characterized by a first pivot joint 22 interconnecting the sections 14 and 18 for folding the foot section 18 into the storage space 16 in a storage position. A second pivot joint 28 interconnects the toe portion 26 and the intermediate portion 24 for folding the toe portion 26 under the intermediate portion 24 and into the storage space 16 in the storage position. Slats 36 on the intermediate portion 24 and on the arcuate section 14 are disposed next to one another at a break position 38 spaced a distance (d) from the first connection 22 in the direction of the support platform 12 for providing a storage opening 40 to receive objects to be stored between the stringers 30 and 32 of the arcuate section 14 and the intermediate portion 24. A shelf 44 extends transverse to the slats 36 for supporting objects stored between the stringers 30, 32 and 34 in the storage position.

14 Claims, 3 Drawing Sheets

10
12
14
18
20
22
24
26
28
30
32
34
37
50

20
36
48
26
44
24
46
36
48
46
16
52
14
12
54

20
26
36
34
18
34
28
28
48
37
44
36
32
24
32
50
36
12
22
22
30
30
37
14

EXERCISE ASSEMBLY

BACKGROUND OF THE INVENTION

1. Field of the Invention

The subject invention relates to an assembly for supporting a human body to provide therapeutic and relaxation benefits and, more particularly, to a back bender.

2. Description of the Prior Art

Various types of exercise assemblies are known for supporting the back of the human body. For example, the U.S. Pat. Nos. to 4,927,139 to Taltre and 5,795,276 to Almeda disclose back benders which provide fixed curvatures. Such back benders occupy a burdensome amount of space. Although there are other body supporting assemblies, as disclosed in U.S. Pat. No. 4,927,135 to Nieppola, which are foldable, they do not provide the requisite back bending curvature.

SUMMARY OF THE INVENTION AND ADVANTAGES

An exercise assembly comprising a support platform for resting upon a floor, an arcuate section extending upwardly and rearwardly from the platform to define a storage space between the platform and the arcuate section, and a foot section extending from the arcuate section to a distal end for resting upon a floor in a use position. The assembly is characterized by a first connection interconnecting the sections for folding the foot section into the storage space in a storage position.

Accordingly, the subject invention provides an exercise assembly for use as a back bender having the requisite curvature to support the spine of a back from end to end, yet may be folded to a compact storage position. In addition, the storage position facilitates the storage of objects within the folded confines of the assembly.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
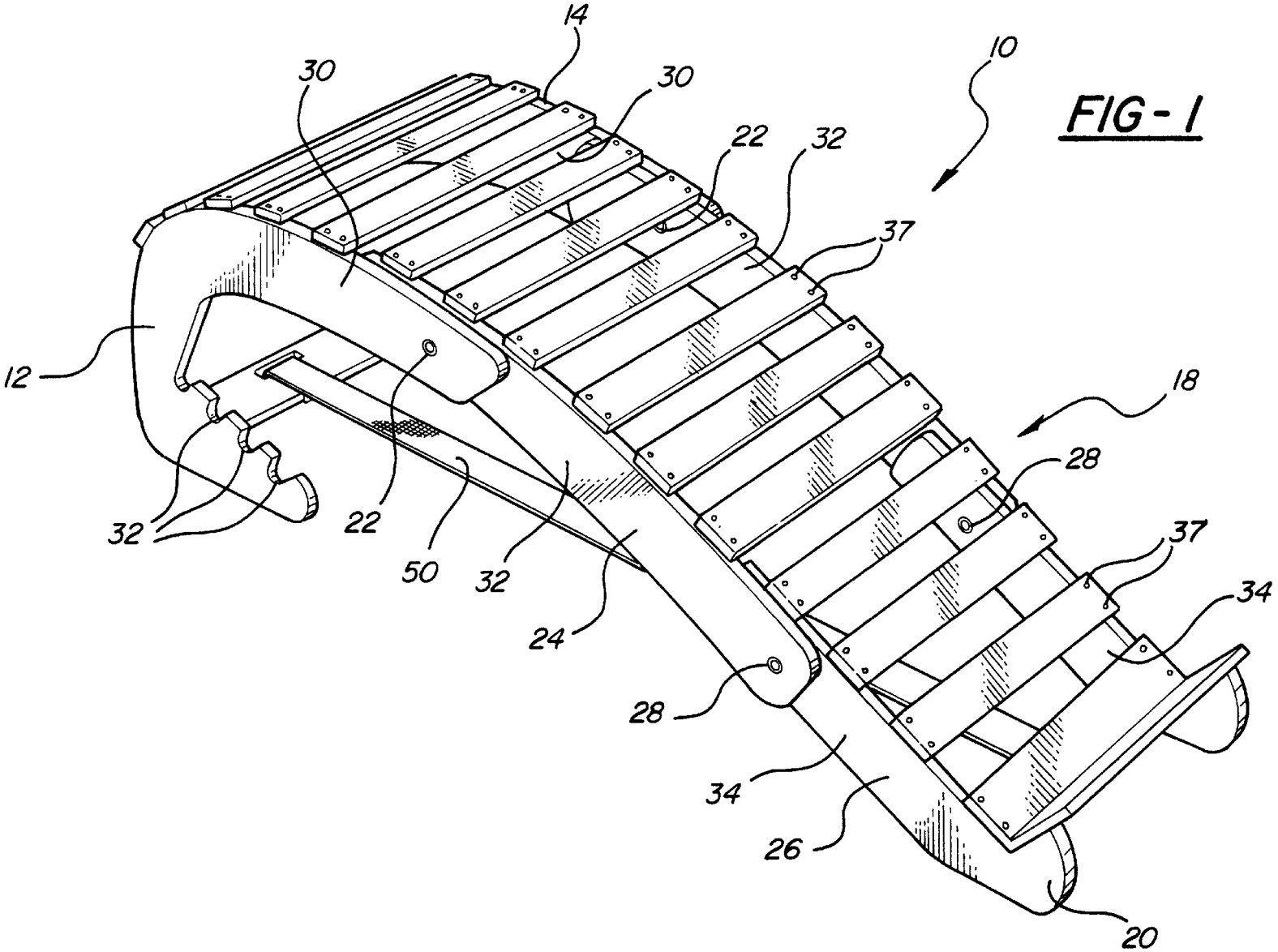
FIG. 1 is a perspective view of a preferred embodiment.
Figure 2:
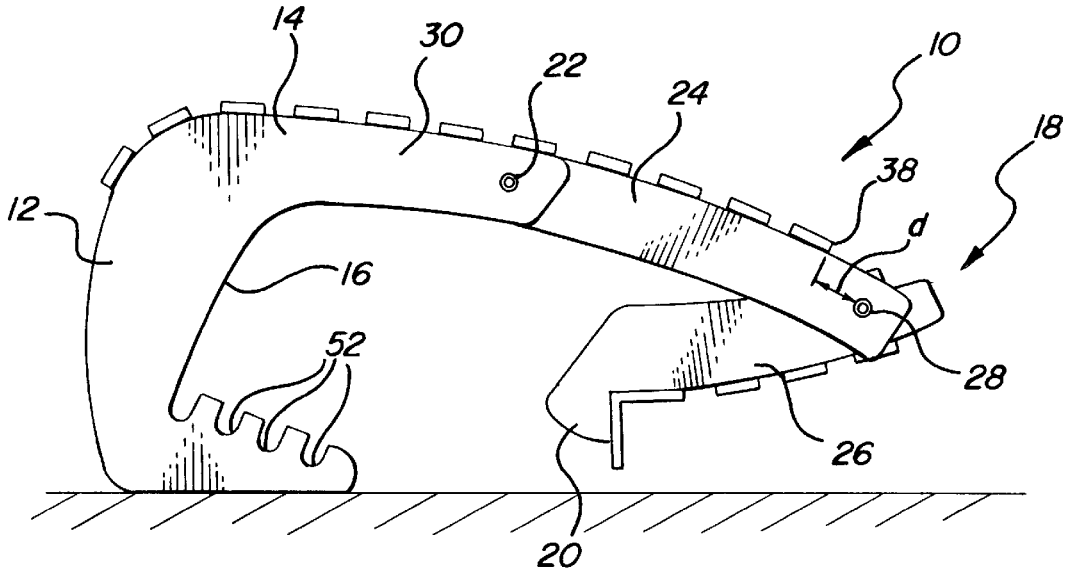
FIG. 2 is side elevational view showing a partially folded position.

Referring to the Figures, wherein like numerals indicate like or corresponding parts throughout the several views, an exercise assembly is generally shown at 10.

The assembly 10 includes a support platform 12 for resting upon a floor, or other support surface. An arcuate section 14 extends upwardly and rearwardly from the platform 12 to define a storage space 16 between the platform 12 and the arcuate section 14. And a foot section, generally indicated at 18, extends from the arcuate section 14 to a distal end 20 for resting upon a floor in a use position.

The assembly is characterized by a first connection or pivot joint 22 interconnecting the sections 14 and 18 for folding the foot section 18 into the storage space 16 in a storage position.

The curvature of the sections 14 and 18 increases from the distal end 20 of the foot section 18 to the platform 12 in the use position. Although the foot section 18 is curved, it is curved less than the arcuate section 14, i.e., its slope changes less. Said another way, the curvature of the sections 14 and 18 extends through more than ninety degrees between the platform 12 and the distal end 20 in the use position. Therefore, the assembly has an overall teardrop configuration with one flat side, which rests upon the floor.

The foot section 18 includes an intermediate portion 24 and a toe portion 26 extending to the distal end 20 for resting upon a floor. The intermediate portion 24 is pivotally connected to the arcuate section 14 by the first connection 22 for pivoting the intermediate portion 24 into overlying relationship with the arcuate section 14, as best viewed in FIGS. 3 and 4. A second connection or pivot joint 28 is included for interconnecting the toe portion 26 and the intermediate portion 24 for folding the toe portion 26 under the intermediate portion 24 and into the storage space 16 in the storage position. The first and second connections 22 and 28 comprise bolts extending through the overlapping stringers 30, 32 and 34.

Each of the sections 14 and 18 comprise a pair of parallel stringers 30, 32 and 34, stringers 30 for the arcuate section 14, stringers 32 for the intermediate portion of the foot section 18. A plurality of cross members interconnect the stringers 30, 32 and 34. Although the cross members may comprise a single sheet for each of the pairs of stringers 30, 32 and 34, as illustrated, the cross members or slats 36 comprise a plurality of slats 36 disposed in parallel and spaced relationship to one another. The stringers 30, 32 and 34 and the slats 36 preferably consist of wood with the slats 36 secured to the stringers 30, 32 and 34 by adhesive or screws 37.

The cross members or slats 36 on the intermediate portion 24 and on the arcuate section 14 are disposed next to one another at a break position 38 spaced a distance (d) from the first connection 22 in the direction of the support platform 12 for providing a storage opening, generally indicated at 40, to receive objects to be stored between the stringers 30 and 32 of the arcuate section 14 and the intermediate portion 24.

Figure 6:
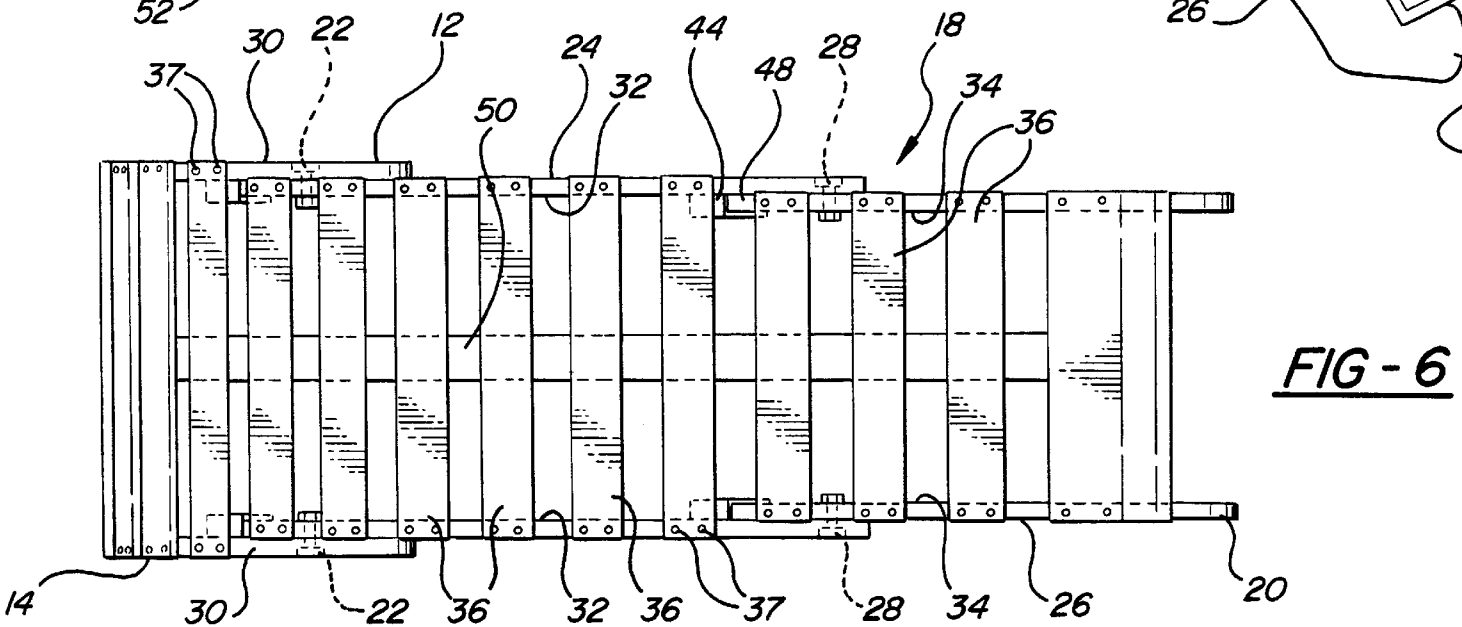
FIG. 6 is a plan view showing the relative positions of the stringers.

As best viewed in FIG. 6, the stringers 34 of the toe portion 26 are disposed inwardly of or closer together than the stringers 32 of the intermediate portion 24 and the stringers 32 of the intermediate portion 24 are disposed inwardly of or closer together than the stringers 30 of the arcuate section 14 whereby the toe portion 26 may be folded into the storage position in the storage space 16 between the arcuate section 14 and the intermediate portion 24.

Figure 3:
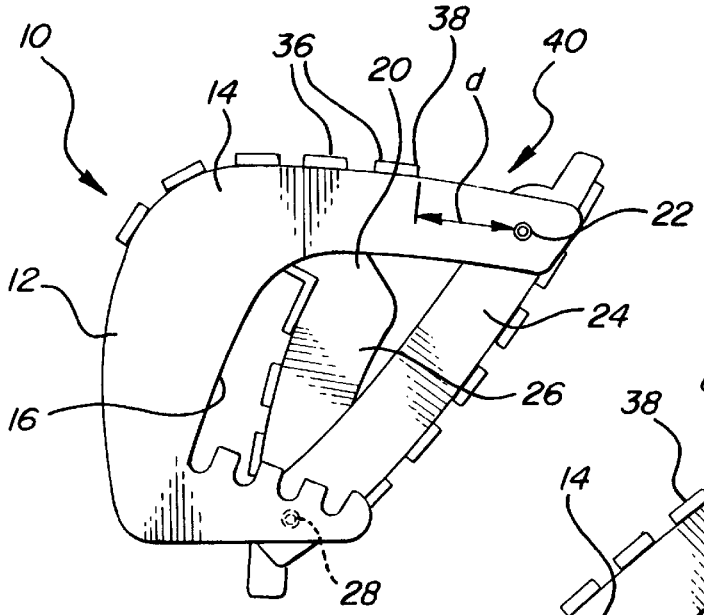
FIG. 3 is side elevational view showing a fully folded storage position.
Figure 4:
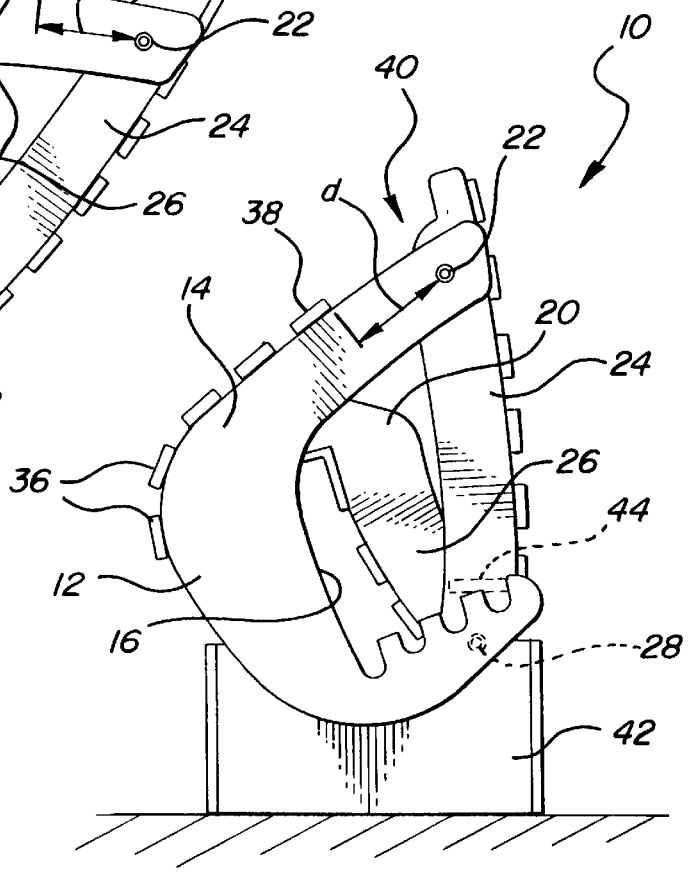
FIG. 4 is side elevational view showing a storage position resting on a base.
Figure 5:
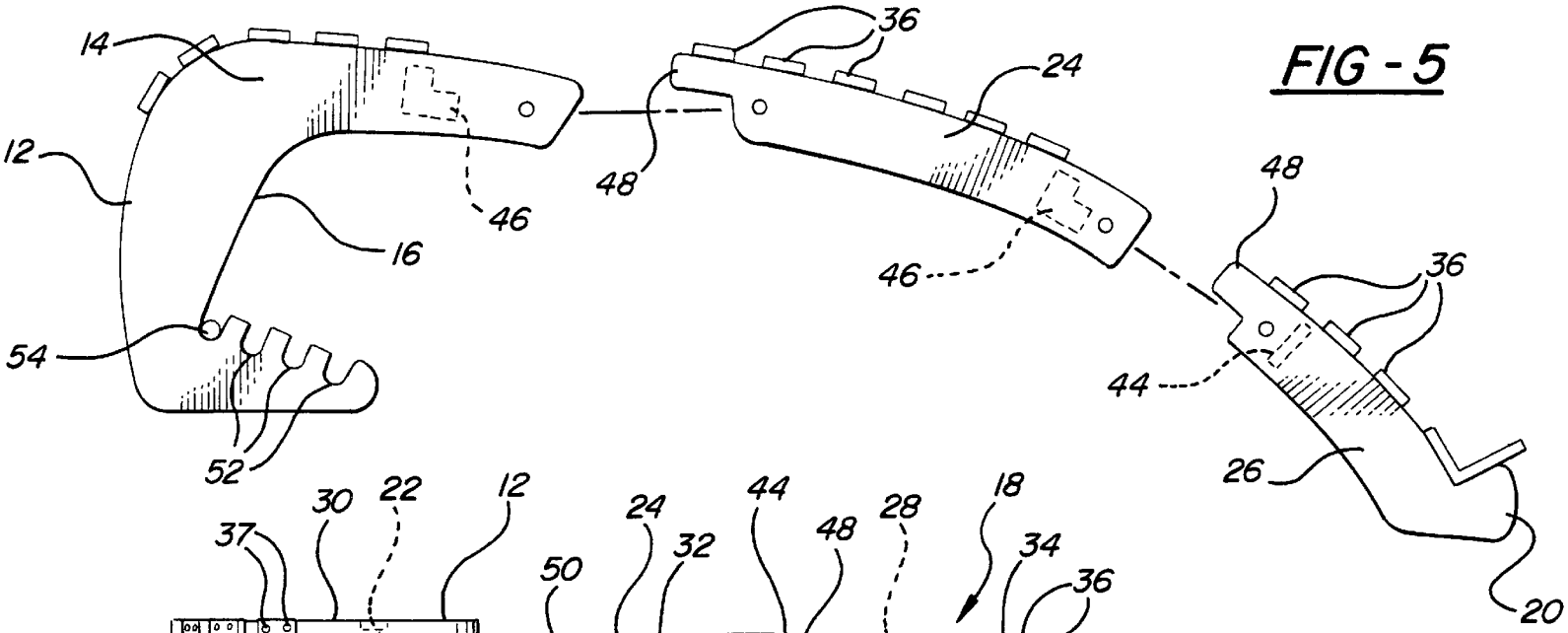
FIG. 5 is an exploded view.

Once folded to the storage position shown in FIGS. 3 and 4, the support platform 12 may be supported in a base or stand 42 which receives and supports the support platform 12 with the arcuate section 14 extending upwardly therefrom whereby the storage opening 40 is disposed above the base 42, i.e., opens upwardly. In regard to storing objects, a shelf 44 extends between the stringers 34 of the toe portion 26 adjacent the second connection 28 and transverse to the slats 36 for supporting objects stored between the stringers 30, 32 and 34 in the storage position.

The assembly includes locks 46 for limiting relative pivotal movement at the first and second pivotal connections 20 and 28 to establish the use position. The locks 46 comprise blocks secured by nails, adhesive, or the like, to the inside of the stringers 30 and 32 for engaging or abutting projections 48 from the ends of the stringers 32 and 34 of the intermediate and toe portions 24 and 26. The locks 46 limit unfolding relative pivotal movement about the pivotal connections 22 and 28.

Alternatively, or in addition to the locks 46, a flexible strap 50 interconnects the distal end 20 of the toe portion 26 of the foot section 18 and the support platform 12 for limiting unfolding movement of the sections 14 and 18 about the pivotal connections 22 and 28 in the use position.

The stringers 30 of the support platform 12 include a plurality of scallops 52 for receiving and supporting a rod 54, which is used for stretching.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

What is claimed is:

1. An exercise assembly comprising;

a support platform 12 for resting upon a floor, an arcuate section 14 extending upwardly and rearwardly from said platform 12 to define a storage space 16 between said platform 12 and said arcuate section 14, and a foot section 18 extending from said arcuate section 14 to a distal end 20 for resting upon a floor in a use position, said assembly characterized by a first connection 22 interconnecting said sections 14 and 18 for folding said foot section 18 into said storage space 16 in a storage position.

2. An assembly as set forth in claim 1 including a flexible strap 50 interconnecting said distal end 20 of said foot section 18 and said support platform 12 for limiting unfolding movement of said sections 14 and 18 in said use position.

3. An assembly as set forth in claim 1 wherein said foot section 18 is curved.

4. An assembly as set forth in claim 3 wherein the curvature of said sections 14 and 18 increases from said distal end 20 of said foot section 18 to said platform 12 in said use position.

5. An assembly as set forth in claim 4 wherein the curvature of said sections 14 and 18 extends through more than ninety degrees between said platform 12 and said distal end 20 in said use position.

6. An assembly as set forth in claim 1 wherein said foot section 18 includes an intermediate portion 24 and a toe portion 26 extending to said distal end 20 for resting upon a floor, said intermediate portion 24 being pivotally connected to said arcuate section 14 by said first connection 22 for pivoting said intermediate portion 24 into overlying relationship with said arcuate section 14, and a second connection 28 interconnecting said toe portion 26 and said intermediate portion 24 for folding said toe portion 26 under said intermediate portion 24 and into said storage space 16 in said storage position.

7. An assembly as set forth in claim 6 wherein each of said sections 14 and 18 comprise a pair of parallel stringers 30, 32 and 34 and cross members interconnecting said stringers 30, 32 and 34.

8. An assembly as set forth in claim 7 wherein said cross members on said intermediate portion 24 and said arcuate section 14 are disposed next to one another at a break position 38 spaced from said first connection 22 in the direction of said support platform 12 for providing a storage opening 40 to receive objects to be stored between said stringers 30 and 32 of said arcuate section 14 and said intermediate portion 24.

9. An assembly as set forth in claim 8 wherein said stringers 34 of said toe portion 26 are disposed inwardly of said stringers 32 of said intermediate portion 24 and said stringers 32 of said intermediate portion 24 are disposed inwardly of said stringers 30 of said arcuate section 14 whereby said toe portion 26 may be folded into said storage position in said storage space 16 between said arcuate section 14 and said intermediate portion 24.

10. An assembly as set forth in claim 9 wherein said cross members comprise a plurality of slats 36 disposed in parallel and spaced relationship to one another.

11. An assembly as set forth in claim 10 including a base 42 for receiving and supporting said support platform 12 with said arcuate section 14 extending upwardly therefrom whereby said storage opening 40 is disposed above said base 42.

12. An assembly as set forth in claim 11 wherein said stringers 30 of said support platform 12 includes a plurality of scallops 52 for receiving and supporting a rod 54.

13. An assembly as set forth in claim 11 including a shelf 44 extending between said stringers 34 of said toe portion 26 adjacent said second connection 28 and transverse to said slats 36 for supporting objects stored between said stringers 30, 32 and 34 in said storage position.

14. An assembly as set forth in claim 1 including locks 46 for limiting relative pivotal movement at said first and second pivotal connections to establish said use position.

* * * * *